US006712113B1

(12) United States Patent
Peggion

(10) Patent No.: US 6,712,113 B1
(45) Date of Patent: Mar. 30, 2004

(54) AUTOMATIC DEVICE FOR DISPENSING AND APPLYING ADHESIVE TAPE IN ROLLS

(76) Inventor: Fenando Peggion, Via Punara, 1, San Giorgio delle Pertiche Padova (IT), I-35010

( * ) Notice: Subject to any disclaimer, the term of this patent is extended or adjusted under 35 U.S.C. 154(b) by 0 days.

(21) Appl. No.: 10/129,612

(22) PCT Filed: Nov. 2, 2000

(86) PCT No.: PCT/IT00/00438

§ 371 (c)(1),
(2), (4) Date: May 8, 2002

(87) PCT Pub. No.: WO01/34507

PCT Pub. Date: May 17, 2001

(30) Foreign Application Priority Data

Nov. 8, 1999 (IT) ..... CR99A0011

(51) Int. Cl.[7] ..... B32B 31/18

(52) U.S. Cl. ..... 156/577; 156/574; 225/23; 225/43; 225/89

(58) Field of Search ..... 156/574, 577; 225/6, 23, 39, 43, 67, 89

(56) References Cited

U.S. PATENT DOCUMENTS 3,709,761 A * 1/1973 Trueb et al. ..... 156/576
3,725,182 A * 4/1973 Regan ..... 156/527
3,745,086 A * 7/1973 Parker ..... 156/527
3,850,779 A * 11/1974 Pearson ..... 156/523
4,344,813 A * 8/1982 Holoff et al. ..... 156/527
4,345,966 A 8/1982 Iiyama et al.
4,582,558 A * 4/1986 Antonson ..... 156/523
4,792,375 A 12/1988 Lin
4,804,437 A 2/1989 Tirtoprodjo et al.
5,181,983 A * 1/1993 Sakai ..... 156/523
5,326,421 A 7/1994 Taylor
5,670,014 A * 9/1997 Mendelovich et al. ..... 156/523

FOREIGN PATENT DOCUMENTS

GB 2214898 A 9/1989

* cited by examiner

*Primary Examiner*—Mark A. Osele
(74) *Attorney, Agent, or Firm*—Young & Thompson

(57) ABSTRACT

Automatic device for dispensing and applying adhesive tape onto surfaces to be joined, using ordinary adhesive tape of the kind used in offices, schools, workshops, businesses and DIY, etc., includes a casing supporting a roll of adhesive tape and a cutting blade facing a tail of unwound adhesive tape, as well as a mobile application part controlled by the user, for the direct application under pressure of the adhesive tape onto the surfaces to be joined and that cooperate, during the application and cutting phase of the adhesive tape, with [[said]] the blade which is movable due to kinematic parts for the connection with the mobile application part.

20 Claims, 4 Drawing Sheets

AUTOMATIC DEVICE FOR DISPENSING AND APPLYING ADHESIVE TAPE IN ROLLS

BACKGROUND OF THE INVENTION

The present invention concerns an automatic device for dispensing and applying adhesive tape onto surfaces to be joined, using ordinary adhesive tape of the kind used in offices, schools, workshops, businesses and DIY, etc.

DESCRIPTION OF THE RELATED ART

Desk-top dispensers of adhesive tape in rolls are well known, featuring a heavy base for stability, comprising a roll-holder casing and a fixed blade for cutting the tape to the required length.

Similarly, a number of light and portable, non stabilized dispensers are known, these too comprising a roll-holder casing and a fixed cutting blade.

In addition, special adhesive tape dispensers are also known for packaging applications comprising a roll-holder casing, a handle and a fixed cutting blade.

The dispensers with a heavy base have a number of inherent problems: they force the user to move position in order to remove the tape, or alternatively to move the heavy device itself; theft are not stable on particularly smooth surfaces and thus can slide towards the user, slip and fall, or otherwise force the user to hold the device with one hand.

The portable dispensers are easier to handle, yet they do not allow, or at least they make it difficult for the user to cut longer pieces of adhesive tape and they force the user to use both hands for the operation.

Both kind of dispensers described above also have a number of defects in common: they force the user to handle the cut tape with its fingers, with the risk of dirtying it, getting it coiled up or sticking to itself or sticking it to other paper surfaces by mistake, thus ruining the tape they force the user to use both hands to apply longer pieces of tape, with the risk, due to static electricity, of attracting the sheets of paper to be joined and thus creating an imperfect joint; they don't allow the cutting of very short pieces of tape; they force the user to add more tape if the first piece is cut too short, or vice-versa to cut the tape a second time if the piece is too long, or to calculate the exact length of the tape to be cut.

The dispensers of adhesive tape for sealing boxes and for packaging in general, finally, are not suitable for more precise office applications: they do not allow to precisely define the starting point for the application of the tape, as the latter hangs from the dispenser; they force the user to make wide, strong and firm movements with arm and wrist to cut the tape, the length of which can in any case not be determined with precision.

SUMMARY OF THE INVENTION

It is the aim of the present invention to eliminate above mentioned inconveniences.

One particular aim of the present invention consists in allowing the direct application, using just one hand, of the adhesive tape onto the surfaces to be joined, starting from a precise point and ending at a second point in correspondence to which the tape is automatically cut without having to remove the dispenser from the surface to which the tape is being applied.

A further aim of the present invention is the realization of a device which can be loaded with commonly available rolls of adhesive tape.

The aims set forth are reached by means of automatic device for dispensing and applying adhesive tape in rolls according to the present invention, comprising a casing which holds a roll of adhesive tape, and a cutting blade facing the tail of the unwound tape, characterized in that the blade is connected to mobile application means, controlled by the user, for the direct application under pressure of the adhesive tape onto the surfaces to be joined, and which cooperate, in the application and cutting phase of the tape, with said blade, mobile on the casing due to a kinematic connection of the latter to said mobile application means.

The advantages offered by the present invention mainly consist in that: the tape does not need to be handled; the tape does not need to be cut to a length longer than the one required; the application of the tape is highly precise; there is no need to use both hands to apply the tape; the device is easy-to-handle, ergonomic, practical and convenient, both in its use and its convenience.

The automatic device for dispensing and applying adhesive tape in rolls according to the present invention will be described more in detail hereinbelow relating to the enclosed drawings in which one embodiment is shown.

Figure 1:
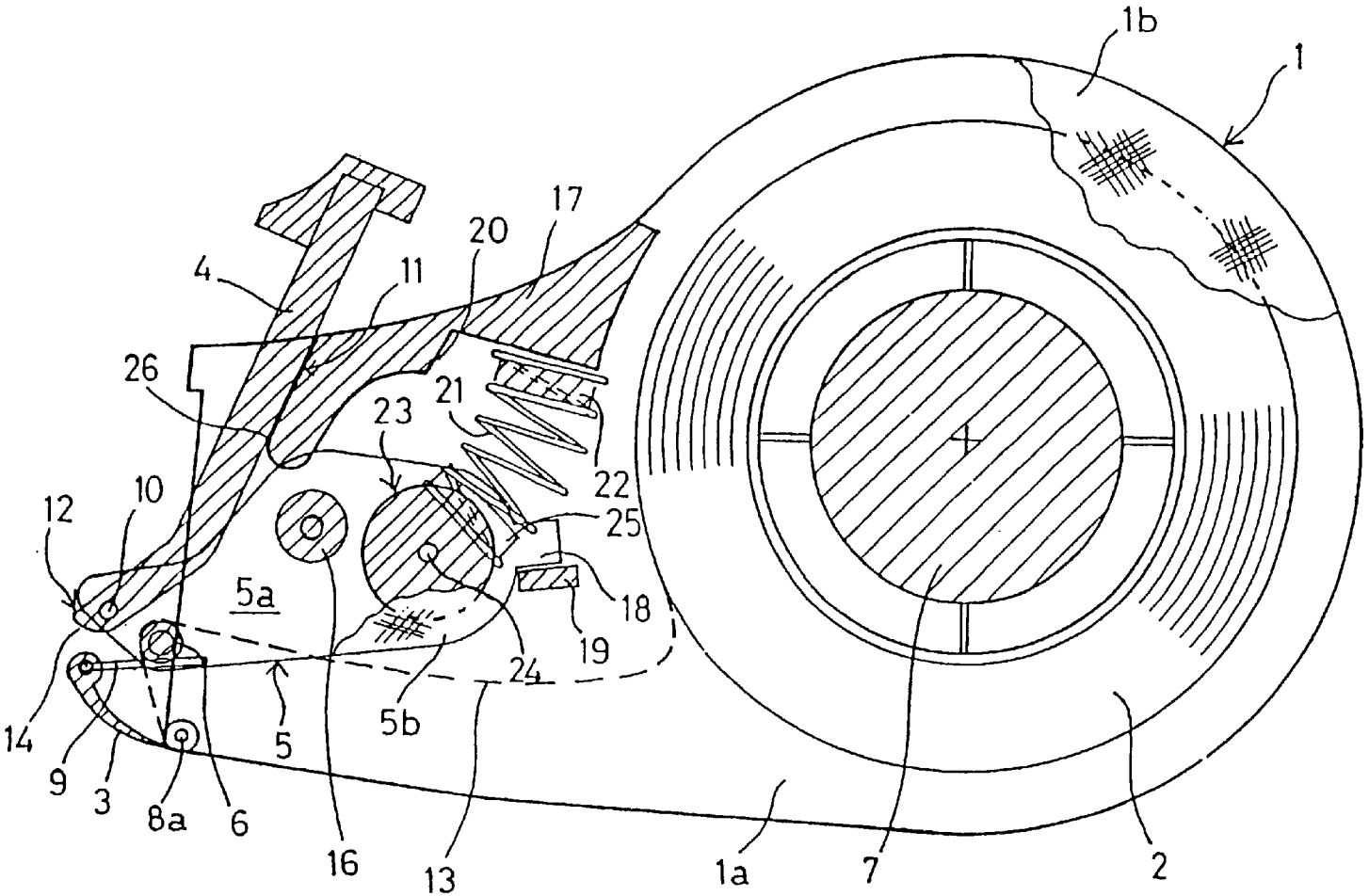
FIG. 1 shows, in a cross-section of the plane perpendicular to the axis of rotation of the roll of adhesive tape, an automatic device for dispensing and applying adhesive tape in rolls, shown in its resting position.

The device according to the present invention mainly consists of:

a casing 1 holding a roll 2 of adhesive tape;

a cutting blade 3;

a control button 4;

a rocker 5;

a tightening roller 6.

DESCRIPTION OF THE PREFERRED EMBODIMENTS

The casing 1 holding the roll 2 of adhesive tape comprises essentially flat and parallel sides 1*a* and 1*b*, connected by a multi-function structure 17.

The roll of adhesive tape 2, of known kind, is rotatingly supported in said casing 1 by a roller 7, which is fixed to said sides 1*a* and 1*b*.

The cutting blade 3 is rotatingly supported in said casing 1 by hinge 8*a* and 8*b*, and is connected to a rocker 5 by at least one rod 9.

The control button 4 is rotatingly connected to said rocker 5 by means of a pin 10 and can freely slide along a surface 11 of the multi-function structure 17.

Furthermore, the shank of said button 4 may rotate and move around the fulcrum of said structure 17, consisting of its nose 26.

Figure 6:
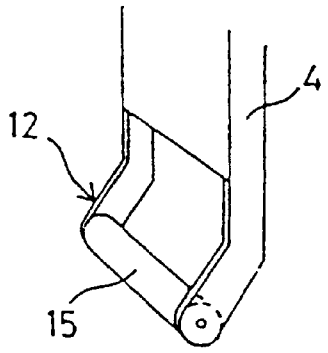
FIGS. 6 and 7 show, in a perspective view, two alternative realization solutions in the area where pressure is applied to the adhesive tape by the application means.
Figure 7:
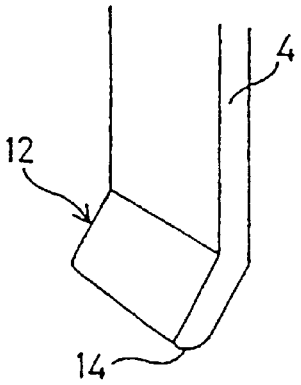

The end 12 of said button 4 in contact with a tail 13 of the adhesive tape is shaped with a convex surface 14, or alternatively, it includes a roller 15 which is rotatingly supported by said end 12. See FIG. 6.

Figure 2:
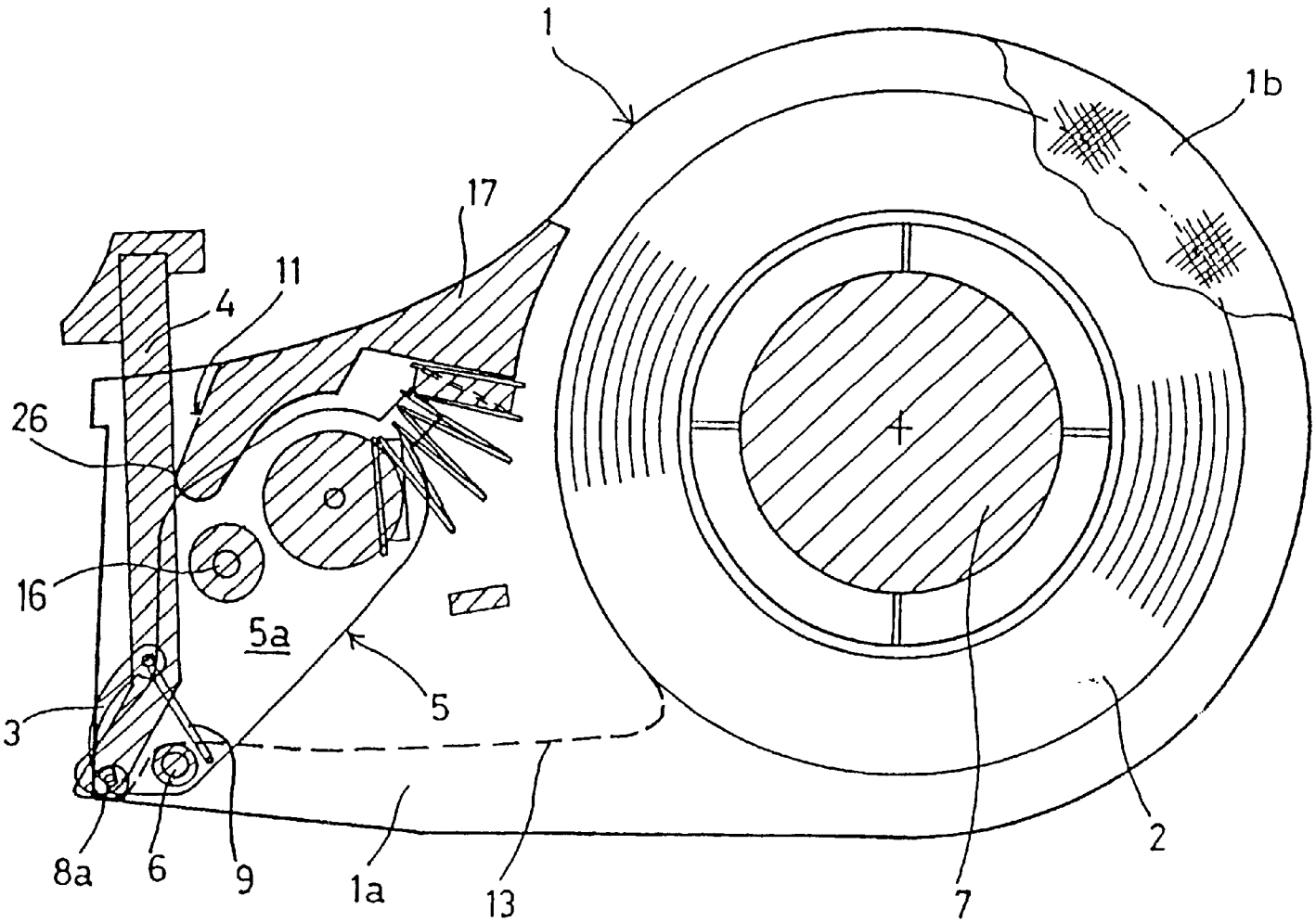
FIG. 2 shows the view of FIG. 1, with the device in the position it assumes when applying the adhesive tape.
Figure 3:
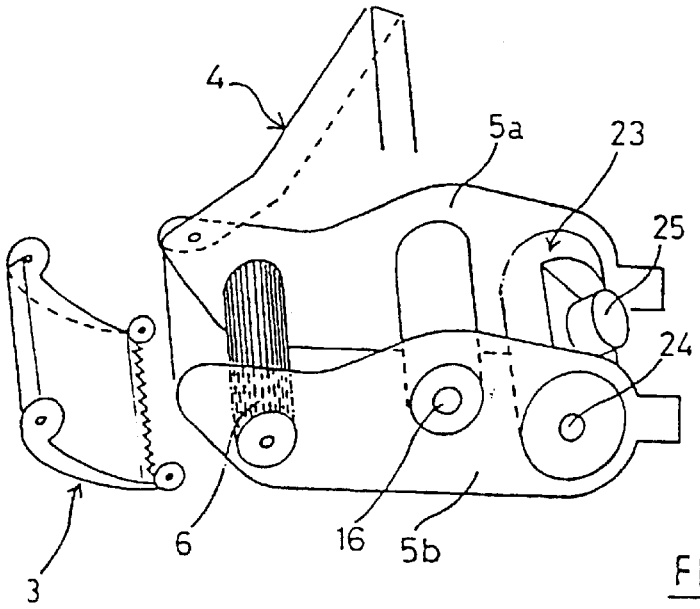
FIG. 3 shows, in a partially-exploded perspective view, details of the mobile application and cutting means.
Figure 4:
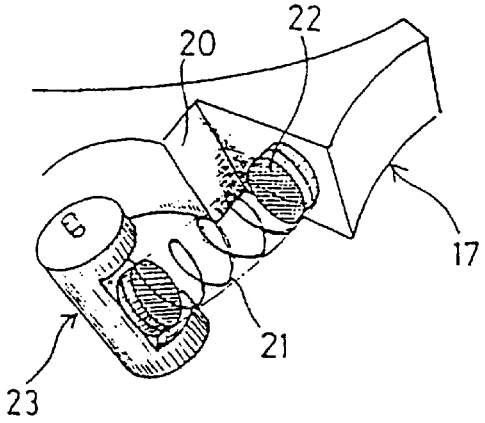
FIG. 4 shows, in a perspective view, details of the activation spring in the cutting device.
Figure 5:
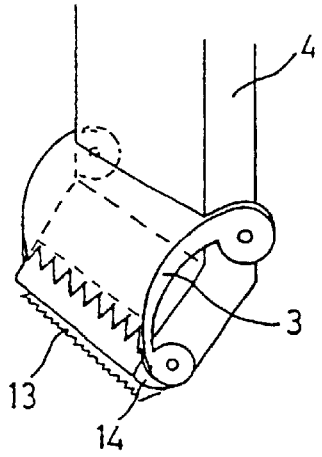
FIG. 5 shows, in a perspective view, details of the position of the application and cutting means during the application of the adhesive tape.

The rocker 5 comprises two parallel, flat shaped surfaces 5*a* and 5*b*, in turn connected by a pin 16, which is rotatingly supported by the sides 1*a* and 1*b* of the casing 1. See FIGS. 1–3.

The tightening roller 6, which also acts as a guide for the tail 13 of the roll 2 of the adhesive tape, is rotatingly supported by the front side of said rocker 5.

The surface of said roller 6, being in contact with the adhesive side of the tape, has grooves or knurls designed for reducing or limiting the tape from sticking to said roller itself.

The rear of the rocker 5 comprises a tooth 18, which alternates between the limit stops of, at one end, a structure 19 fixed to the casing 1 and, at the opposite end, a surface 20 of the structure 17.

Finally, a spring 21 is connected between said structure 17 and the rocker 5. The end of the spring connected to the structure 17 is fastened to a button 22, while the end connected to said rocker 5 is fastened to a button 25 of a structure 23, rotatingly supported by said rocker by means of a pin 24.

Due to said restrains and connections, the working of the automatic dispenser and applicator of adhesive tape according to the present invention may be described as follow.

According to the details shown in FIGS. 1, 2, 8 and 9, in the initial resting position, the tail 13 of the adhesive tape is stretched between the roll 2 and the cutting blade 3, passing above the tightening roller 6.

In this phase, the spring 21 pushes the rear part of the rocker 3 downwards, causing—as a consequence—the raising of the front end of said rocker 5 and of the control button 4.

In this position, said tightening roller 6 is further forward than the end of said blade 3.

To start the application of the adhesive tape on the surfaces to be joined, the device will be positioned so that said cutting blade 3, to which the end of said tail 13 is attached, is placed at the starting point of the section to be joined.

Then, on pressing the control button 4, the shank of said button slides alone the surface 11 of the structure 17, causing the lowering of the front part of said rocker 5, and the consequence raising of its rear part until the tooth 18 gets into contact with the surface 20, causing the compression of the spring 21 and the rotation and raising of the cutting blade 3.

The lowering of the front part of said rocker 5 also causes the tightening roller 6 to move backwards inside the casing 1 with respect to said blade 3.

Figure 8:
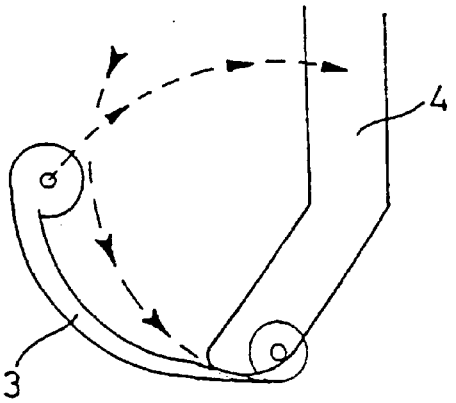
FIG. 8 is a schematic diagram of the movement directions of the application and cutting means at the beginning of the application phase of the adhesive tape.
Figure 9:
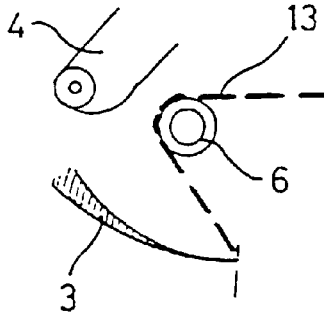
FIG. 9 is a schematic diagram of the sequence of positions of the application and cutting means at the beginning of the application phase of the adhesive tape.
Figure 9:
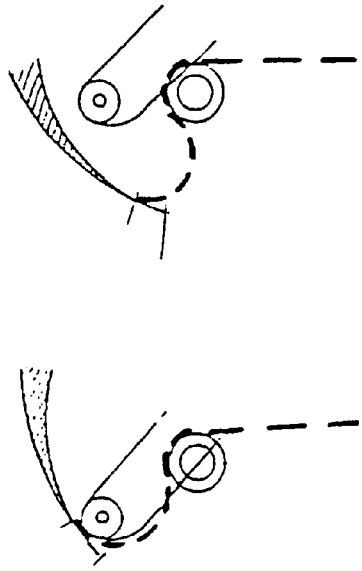

The trajectories of the movements of the end 12 of the button 4 and of the cutting blade 3 are shown with dashed lines and arrows in FIG. 8, while the four typical positions assumed during the various phases by these components, as well as by the tightening roller 6 and by the end of the tail 13 of the adhesive tape, are shown in FIG. 9.

With particular reference to the latter figure, during the lowering of the button 4 and the raising of the blade 3, the adhesive tape resting on the tightening roller 6 is removed from said blade and made to stick to the surfaces to be joined by the end 12, which applies a pressure an the tape itself by means of the convex surface 14 or by the rotating roller 15, making the end of the tail of the adhesive tape rest against the internal surface of the blade 3 and slide downwards until the cutting teeth, before leaving the device to the front of the blade and sticking to the surfaces to be joined.

When the adhesive tape has been applied up to the end of the required section, the button 4 is pulled towards the multifunction structure 17. The shank of said button 4 pushes against said structure 17 in the fulcrum consisting of the nose 26 and slides along the surface 11.

This movement causes the opposite movement of the previously described parts and the cutting of the adhesive tape due to the rotation of the blade 3 and the moving forwards of the tightening roller 6 with respect to the end of said blade. The final clicking into place of said cutting blade 3 is favoured by the spring 21, which acts on the rear of the rocker 5, until said rocker stops against the fixed structure 19.

What is claimed is:

1. A dispenser device for automatically applying adhesive tape in a roll, comprising:

a casing (1) holding a roll (2) of adhesive tape;

a cutting blade (3) rotatingly supported about hinges within the housing and onto which cutting blade a tail (13) of adhesive tape, unrolled from the roll, is bears so that an edge of the cutting blade provides a cutting point of the tape;

a selectively controllable movable operating means for direct, pressure application of said tape onto surfaces to be united, said movable operating means comprising a pushbutton (4), a rocker (5) and a tightening roller (6); and kinematic means linking with said movable operating means and said blade, said movable operating means cooperating with said kinematic means to rotate said blade (3), about said hinges due to an effect of the kinematic means linking with said movable operating means, so that a point where the application of the tape starts and the cutting point of the tape may coincide with a front edge of said dispenser.

2. A dispenser according to claim 1, characterized in that said pushbutton (4) comprises a shaped end (12) with a convex surface which, in the application of the tape, the convex surface gets into contact with the end of the tail (13) of the adhesive tape, detaching the end of the tail from said blade (3) and applying the end of the tail onto the surfaces to be united.

3. A device according to claim 2, characterized in that said shaped end (12) comprises a small roller (15) rotatingly supported on said shaped end.

4. A device according to claim 1, characterized in that said tightening roller (6) is rotatingly supported in a front part of said rocker (5), and is placed in a position withdrawn with respect to said blade (3) in the application of the tape while the tightening roller comes forward and surpasses said blade during cutting of the tape.

5. A device according to claim 1, characterized in that said rocker (5) is linked to said pushbutton (4), is rotatingly linked to said casing (1), and is in contrast with a bend spring (21).

6. A device according to claim 5, characterized in that said bend spring (21) is provided between a multifunction structure (17) linked to said casing (1), and another structure (23) rotatingly supported by said rocker (5).

7. A device according to claim 1, characterized in that said kinematic means comprise at least one connecting rod (9).

8. A device according to claim 1, characterized in that a surface of roller (6) comprises is textured to reduce adhesion of the tape onto said roller.

9. A device according to claim 1, characterized in that a back part of said rocker (5) comprises a tooth (18) that cooperates in an opposition relationship alternatively with a first limit structure (19), fixed on said casing (1), and with a second limit surface (20) fixed on a multifunction structure (17) linked to said casing.

10. The tape dispenser, comprising:

a casing holding a roll of adhesive tape;

a cutting blade rotatingly supported in said casing;

a rocker connected to said cutting blade;

a control button rotatingly connected to said rocker, an end of said control button being in contact with a tail of the adhesive tape;

a tightening roller positioned as a guide and rest for the tail of the adhesive tape, the roller rotatingly supported by said rocker; and a kinematic element linking with said control button and said blade.

11. The dispenser of claim 10, further comprising:

a multi-function structure connecting two flat and parallel sides of the casing;

a roller fixed to the two sides and rotatingly supporting the roll of tape between the two sides; and hinges rotatingly supporting said blade in said casing.

12. The dispenser of claim 11, further comprising:

at least one rod connecting said rocker to said blade;

a pin rotatingly connecting said control button to said rocker, the control button freely slidable along a surface of said multi-function structure.

13. The dispenser of claim 12, wherein said button comprises a shank rotatable and moveable around a fulcrum of said multi-function structure.

14. The dispenser of claim 10, wherein the end of said button in contact with the tail of the adhesive tape is one of a convex surface and a rotatingly supported roller.

15. The dispenser of claim 10, wherein the rocker comprises two parallel, flat shaped surfaces connected by a pin rotatingly supported by sides of the casing.

16. The dispenser of claim 10, wherein, the tightening roller is rotatingly supported by a front side of said rocker, a surface of said roller, in contact with an adhesive side of the tape, is textured to reduce the tape from sticking to said roller.

17. The dispenser of claim 11, wherein a rear of the rocker comprises a tooth, which tooth alternates between the limit stops of, at one end, a first limit structure fixed to the casing, and, at a second opposite end, a second limit surface of the multi-function structure.

18. The dispenser of claim 11, wherein said kinematic element comprises a spring connected between said multi-function structure and said rocker.

19. The dispenser of claim 18, further comprising:

a rotating structure supported by said rocker, and wherein a first end of the spring connects to the multi-function structure and a second end of the spring connects to said rocker via said rotating structure.

20. The dispenser of claim 19, wherein, from an initial resting position, user-pressure of said control button stretches the tail of the adhesive tape between the roll and the cutting blade, the adhesive tape passing above the tightening roller, the kinematic element pushing a rear part of the rocker downwards and causing said tightening roller to be in a position further forward than an end of said blade; and an application of the adhesive tape on an object can be started by the dispenser being positioned so that said cutting blade, to which the end of said tail is attached, is placed at the starting point on the object, and, on further pressing said control button, causes compression of the kinematic element and rotation and raising of the cutting blade, during the raising of the cutting blade, the adhesive tape resting on the tightening roller is removed from said cutting blade and made to stick to the object, by the control button applying a pressure on the tape.

* * * * *